US005924585A

United States Patent [19]

Henderson et al.

[11] Patent Number: 5,924,585

[45] Date of Patent: Jul. 20, 1999

[54] CONNECTIONS AND METHODS OF RESTRICTING AN OPENING

[75] Inventors: David E. Henderson, Fremont; Daniel M. Thomas, Ripon, both of Calif.

[73] Assignee: VLSI Technology, Inc., San Jose, Calif.

[21] Appl. No.: 09/013,321

[22] Filed: Jan. 26, 1998

[51] Int. Cl.[6] ..... B65D 45/30

[52] U.S. Cl. ..... 215/274; 215/309; 215/319; 215/355

[58] Field of Search ..... 215/274, 280, 215/281, 307, 309, 319, 355, 364; 220/287, 315, 319, 320

[56] References Cited

U.S. PATENT DOCUMENTS

| | | | |
|---|---|---|---|
| 2,019,057 | 10/1935 | Rasmussen | 215/274 |
| 2,062,271 | 11/1936 | Merolle | 215/274 |
| 3,813,223 | 5/1974 | Fleck | 215/309 X |
| 4,541,537 | 9/1985 | Sailor | 215/274 |
| 4,993,573 | 2/1991 | Freidel et al. | 215/309 |

FOREIGN PATENT DOCUMENTS

| | | | |
|---|---|---|---|
| 605811 | 2/1926 | France | 215/281 |

*Primary Examiner*—Stephen K. Cronin
*Attorney, Agent, or Firm*—Wells, St. John, Roberts, Gregory & Matkin P.S.

[57] ABSTRACT

The present invention provides connections and methods of restricting an opening. One connection according to the subject invention is configured to restrict a mouth of a container, the mouth having an inner surface having an inside diameter and an outer surface having an outside diameter, the connection includes: a plug having a side surface of varying dimension and configured to engage the inner surface to form a seal of the side surface of the plug and the inner surface; at least one intermediate member having a first end borne by the plug and a second end distally spaced from the first end; and a securing member configured to engage the outer surface of the container and the second end of the intermediate member, the intermediate member being configured to couple the plug and the securing member and maintain the seal of the side surface of the plug with the inner surface of the container.

25 Claims, 3 Drawing Sheets

CONNECTIONS AND METHODS OF RESTRICTING AN OPENING

TECHNICAL FIELD

The present invention relates to connections and methods of restricting an opening.

BACKGROUND OF THE INVENTION

Various chemicals are utilized in the processing of semiconductor wafers and fabrication of integrated circuitry. Conventional semiconductor processing methods involve layering or depositing thin layers upon the surface of a semiconductor wafer or workpiece. Selected portions of the deposited thin layer may be removed during fabrication steps including patterning. Patterning processes may involve photomasking, masking, photolithography and microlithography. Patterning of the semiconductor workpiece creates surface parts of various devices which make up a circuit.

Such processing steps require the use of chemicals during the processing of semiconductor workpieces. For example, some conventional patterning processes utilize a delicate stencil material known as photoresist. Photoresist and other processing chemicals are usually available from numerous suppliers. The processing chemicals are often supplied in containers of various shapes and sizes. In addition, the containers may have openings or apertures which are of various sizes and include threaded patterns of varying dimensions.

Typical semiconductor processors include pumps configured to draw the desired chemicals from the containers. The chemicals are applied to a processing chamber of the semiconductor workpiece processor. As chemicals are consumed from one container during processing, it is necessary to replace exhausted containers with new containers containing a new supply of the particular chemical. It is preferred to replace exhausted containers in a quick manner to minimize stoppage of the processing operation.

It has been observed that numerous adapters may be required to provide appropriate attachment of the processor with the variety of containers utilized by the chemical suppliers. An additional complicating factor exists of having to remove the adaptor from the connection to the pump and inserting a new adaptor with the pump connection for proper attachment to a different replacement container. Further, one must maintain a large supply of accessories or adapters on hand for connection with the differing chemical supply bottles. These problems result from the use of a chemical which may be provided by different suppliers who utilize containers having differing shapes and sizes to house the particular chemical.

Therefore, there exists a need for providing adequate connection and sealing of chemical containers with semiconductor workpiece processors while avoiding the problems associated with conventional attachment devices.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
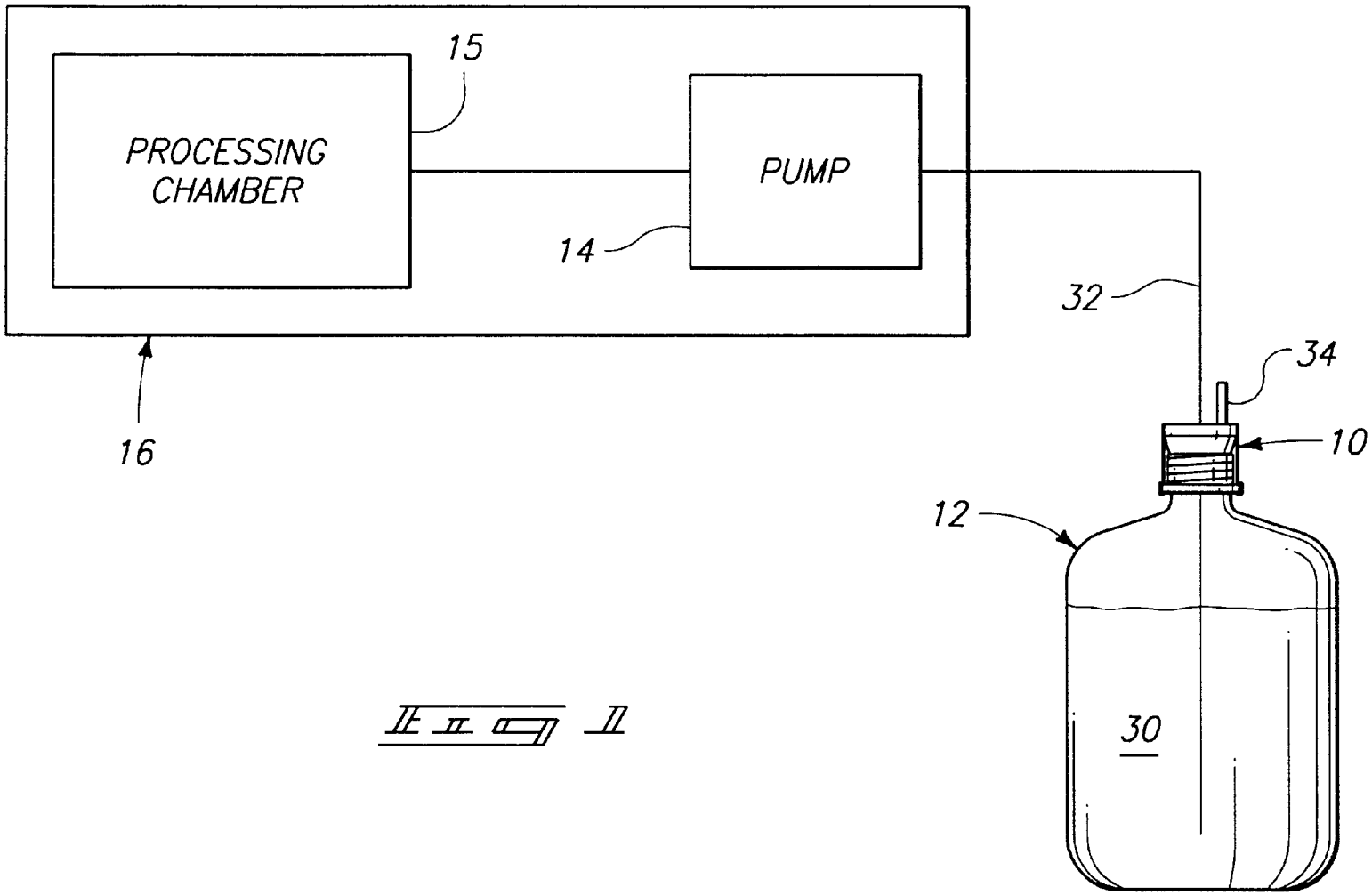
FIG. 1 is an illustrative representation of a connection of a chemical container with a workpiece processor.

This disclosure of the invention is submitted in furtherance of the constitutional purposes of the U.S. Patent Laws "to promote the progress of science and useful arts"(Article 1, Section 8).

The present invention provides a connection, also referred to as an attachment, operable to seal an opening of a mouth or bottleneck of a container. The described connection is operable to seal container mouths of various sizes. The connection restricts or seals openings which have a diameter within a predefined range. The connection is reusable to seal openings of a plurality of containers.

The invention additionally provides methods of restricting an opening of a mouth of a container. The disclosed connections and methods are described herein in the context of semiconductor device fabrication. The present invention is not limited to such uses or applications.

A connection according to a first aspect of the present invention is configured to restrict a mouth of a container, the mouth having an inner surface having an inside diameter and an outer surface having an outside diameter, the connection comprising: a plug having a tapered side surface configured to engage the inner surface to form a seal of the side surface of the plug and the inner surface; at least one intermediate member having a first end borne by the plug and a second end distally spaced from the first end; and a securing member configured to engage the outer surface of the container and the second end of the intermediate member, the intermediate member being configured to couple the plug and the securing member and maintain the seal of the side surface of the plug with the inner surface of the container.

Another aspect of the present invention discloses a method of restricting an opening comprising: providing a plug having a length, and a side surface having a perimetry that varies along the length of the plug; providing a container having a mouth including an inner surface which defines an inside diameter and an outer surface defining an outside diameter; forming a seal between the side surface of the plug and the inner surface of the mouth; providing a securing member about the outer surface of the container; and coupling the plug and the securing member using at least one intermediate member.

Yet another aspect of the present invention provides a reusable connection operable to restrict an opening of a bottle having contents therein, the bottle including a mouth having an inner surface of an inside diameter and an outer surface of an outside diameter, the inside diameter being within a predefined range and the outer surface including plural threads extending about the mouth, the reusable connection comprises: a plug configured to engage the inner surface of the mouth, the plug being frustoconical and having a tapered side surface of varying dimension corresponding to the predefined range, the tapered surface of the plug being configured to form a seal with the inner surface of the mouth, the plug having a first aperture and second aperture individually axially extending from an outer surface of the plug to an inner surface of the plug; a withdrawal tube configured to pass through the first aperture of the plug and permit withdrawal of the contents of the bottle through the plug; a ventilation tube configured to pass through the second aperture of the plug and permit passage of air into the bottle through the plug; a plurality of retaining members individually having a first end and a second end, the first ends of the retaining members being configured for attachment to the plug and the second ends of the retaining members being distally spaced from the respective first ends and configured to form respective loops; and an adjustable retention hook and loop strap provided through the loops of the respective retaining members and the strap being configured for reception between adjacent threads of the mouth to maintain the seal of the tapered surface of the plug with the inner surface of the mouth.

Referring to FIG. 1, a container 12, such as a bottle, is shown in fluid communication with a workpiece processor 16. The illustrated workpiece processor 16 includes a pump 14 and processing chamber 15. An adapter or connection 10, such as a cap or lid, is shown attached to a bottleneck or mouth 18 of the container 12.

In the depicted embodiment, withdrawal and ventilation tubes 32, 34 are provided through connection 10. Pump 14 and workpiece processor 16 are attached to pick-up or withdrawal tube 32. Responsive to suction created by pump 14, chemical contents 30 within container 12 are removed from container 12, drawn into withdrawal tube 32 and applied to processing chamber 15 of workpiece processor 16.

Container 12 is configured to hold appropriate chemicals or other contents 30, such as photoresist, which may be utilized in the fabrication or processing of semiconductor workpieces. Connection 10 is configured to provide a seal with bottleneck or mouth 18 of the container 12 in one embodiment of the invention. Connection 10 is configured for attachment to containers 12 having mouths 18 of various sizes or varied threaded patterns in the described embodiment.

Figure 2:
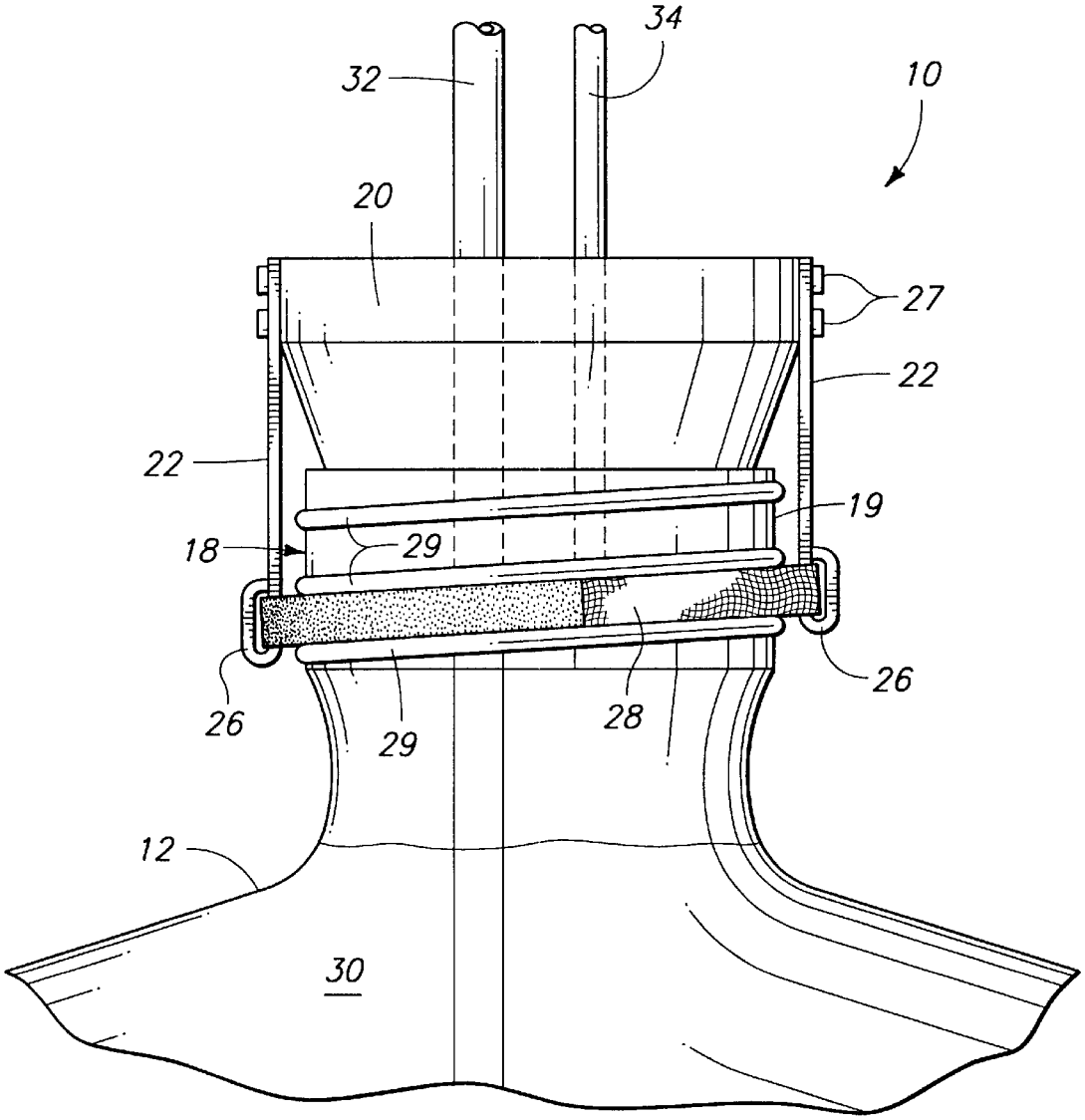
FIG. 2 is an elevational side view of one embodiment of a connection in accordance with the present invention.

Referring to FIG. 2, one embodiment of connection 10 is illustrated in detail. The depicted connection 10 comprises a plug 20, at least one intermediate or retaining member 22 and a securing member 28. Intermediate member 22 and securing member 28 are configured to maintain plug 20 in fixed relation relative to mouth 18 when in use to restrict the opening of mouth 18. Intermediate member 22 maintains plug 20 within a fixed distance of securing member 28 in the illustrated embodiment.

Two intermediate members 22 are provided in the depicted embodiment. Intermediate members 22 include respective first ends borne by plug 20 and respective second ends distally spaced from the respective first ends. A pair of fasteners 27, such as screws, are utilized to secure or attach individual first ends of the intermediate members 22 with plug 20 in the depicted embodiment.

The second ends of intermediate members 22 are individually bent backwards to form respective loops or bight portions 26 in the described embodiment. Bight portions 26 are preferably bent backwards to contact respective intermediate members 22 thereby forming individual enclosures about portions of securing member 28. Intermediate members 22 comprise stainless steel straps in one embodiment of the invention.

Securing member 28 is configured to engage the outer surface 19 of the mouth 18 of container 12. Further, securing member 28 is configured to engage the respective bight portions 26 of intermediate members 22 while connection 10 is in use. Intermediate members 22 are configured to couple plug 20 and securing member 28 and maintain a seal of a side surface of plug 20 with an inner surface of mouth 18 of container 12.

Securing member 28 comprises an adjustable retention strap in the described embodiment. Securing member 28 is preferably adjustable to permit the attachment thereof to bottlenecks or mouths 18 of varying dimensions. Specifically, securing member 28 is adjustable to accommodate mouths 18 having outer surfaces 19 of differing diameters. Other configurations of securing member 28 are possible in other embodiments. Strap 28 includes a hook and loop fastener (e.g., Velcro™) in the described embodiment.

The illustrated mouth 18 of container 12 includes an inner surface 40 and an outer surface 19. Inner surface 40 and outer surface 19 define an inside diameter and outside diameter, respectively. Inner surface 40 further defines an opening of mouth 18. Mouth 18 includes plural threads 29 formed about outer surface 19. Securing member 28 is shown inserted between adjacent threads 29 in FIG. 2. Strap or securing member 28 is configured for reception between adjacent plural threads 29 in one embodiment of the invention. Provision of securing member 28 between adjacent threads 29 minimizes vertical movement of connection 10, including securing member 28 and plug 20, with respect to the mouth 18 of container 12.

Figure 3:
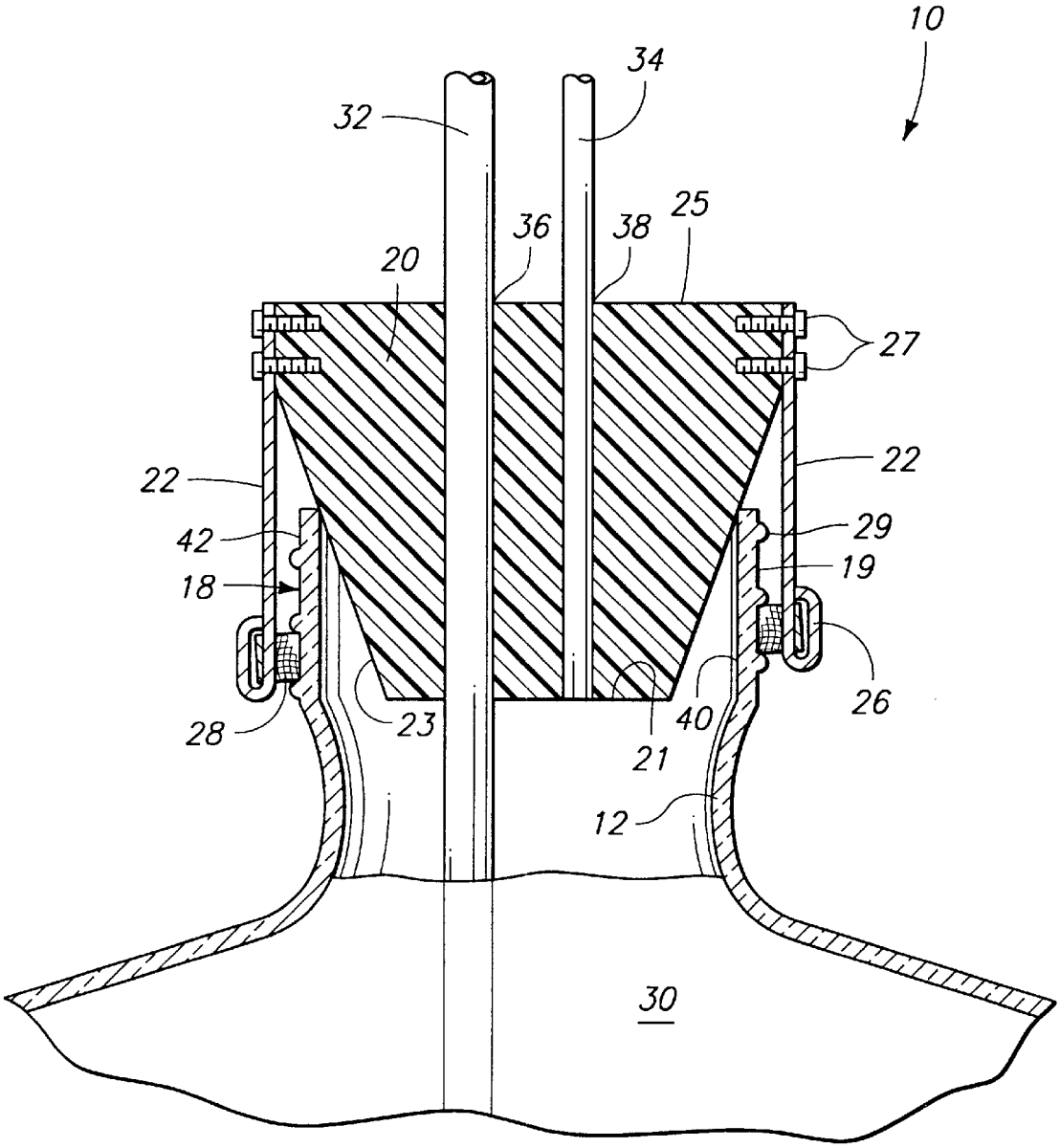
FIG. 3 is a cross-sectional view of the connection shown in FIG. 2.

Referring to FIG. 3, plug 20 is frustoconical in one embodiment of the invention. The plug 20 has a length perpendicular to the inside diameter of the mouth 18 when the plug is in place in the mouth. In particular, plug 20 of connection 10 includes a lower surface 21 of a first diameter facing into the mouth 18 when the plug 20 is positioned to engage the inner surface 40 of mouth 18. Plug 20 additionally includes an upper surface 25 of a second diameter facing away from container 12 when the plug 20 is positioned to engage the inner surface 40 of mouth 18. In the described embodiment of the invention, the second diameter of plug 20 is greater than the first diameter of plug 20.

Plug 20 includes an exterior or side surface 23 of varying dimension between upper surface 21 and lower surface 25. In one embodiment, the varying dimension corresponds to a range of diameters of openings of mouths 18 for which connection 10 will be utilized to seal or restrict. Side surface 23 is tapered in a direction normal to the inside diameter of mouth 18 when plug 20 is positioned to engage the inner surface 40. Side surface 23 has a perimetry that varies along the length of the plug 20. Connection 10 is configured such that side surface 23 of plug 20 engages inner surface 40 of mouth 18 when plug 20 is positioned to restrict the opening of mouth 18. Side surface 23 of plug 20 forms a seal with inner surface 40 of mouth 18. Intermediate members 22 and securing member 28 are configured to maintain the seal of the side surface 23 of plug 20 with the inner surface 40 of mouth 18.

Plug 20 comprises plastic in the described embodiment. In particular, side surface 23 and lower surface 21 of plug 20 are formed of Teflon®, a registered trademark of E.I. duPont de Nemours and Company, in accordance with one embodiment. Plug 20 is formed of other materials in other embodiments. Plug 20 includes openings or first and second apertures 36, 38 which are configured to receive withdrawal tube 32 and ventilation tube 34. First and second apertures 36, 38 axially extend from outer surface 25 of plug 20 to inner surface 21 thereof.

Tubes 32, 34 pass through respective apertures 36, 38 in plug 20. Withdrawal tube 34 preferably extends to the lower portion of container 12 to permit withdrawal of chemicals or contents 30 from lower portions of container 12 through plug 20. Ventilation tube 34 permits air to enter into container 12 through plug 20 facilitating removal of contents 30 via withdrawal tube 32.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A connection configured to restrict a mouth of a container, the mouth having an inner surface having an inside diameter and an outer surface having an outside diameter, the connection comprising:

a plug having a tapered side surface configured to engage the inner surface to form a seal of the side surface of the plug and the inner surface;

at least one intermediate member having a first end borne by the plug and a second end distally spaced from the first end; and a securing member configured to engage the outer surface of the container and the second end of the intermediate member, the intermediate member being configured to couple the plug and the securing member and maintain the seal of the side surface of the plug with the inner surface of the container.

2. The connection according to claim 1 wherein the intermediate member includes a bight portion and the securing member in use, engages the bight portion.

3. The connection according to claim 1 wherein the intermediate member is formed of steel.

4. The connection according to claim 1 wherein the securing member comprises a strap.

5. The connection according to claim 4 wherein the strap includes a hook and loop fastener.

6. The connection according to claim 1 wherein the securing member is adjustable.

7. The connection according to claim 1 wherein the securing member is configured for positioning between plural threads formed about the outer surface of the mouth.

8. The connection according to claim 1 wherein the side surface is tapered in a direction normal to the inside diameter when the plug is positioned to engage the inner surface.

9. The connection according to claim 1 wherein the plug is frustoconical.

10. The connection according to claim 1 wherein the plug has a surface of a first diameter facing into the mouth and a surface of a second diameter facing away from the container when the plug is positioned to engage the inner surface, the second diameter being greater than the first diameter.

11. The connection according to claim 10 wherein the side surface and the surface of the first diameter comprise teflon.

12. The connection according to claim 1 wherein the intermediate member and securing member are configured to maintain the plug in fixed relation relative to the mouth.

13. The connection according to claim 1 wherein the intermediate member is configured to maintain the plug within a fixed distance of the securing member.

14. The connection according to claim 1 wherein an opening of the mouth has a diameter within a predefined range.

15. The connection according to claim 1 wherein the connection is reusable.

16. The connection according to claim 1 wherein the connection is useable with mouths of various sizes.

17. The connection according to claim 1 further comprising a tube configured to pass through the plug.

18. A method of restricting an opening comprising:

providing a plug having a length, and a side surface having a perimetry that varies along the length of the plug;

providing a container having a mouth including an inner surface which defines an inside diameter and an outer surface defining an outside diameter;

forming a seal between the side surface of the plug and the inner surface of the mouth;

providing a securing member about the outer surface of the container; and coupling the plug and the securing member using at least one intermediate member.

19. The method according to claim 18 wherein the side surface is tapered.

20. The method according to claim 18 wherein the providing the securing member comprises inserting the securing member between plural threads formed about the outer surface of the mouth.

21. The method according to claim 18 further comprising adjusting the securing member to accommodate mouths having outer surfaces of differing diameters.

22. The method according to claim 18 further comprising maintaining the seal using the securing member and the intermediate member.

23. The method according to claim 18 further comprising:

inserting a tube through the plug; and removing contents of the container using the tube.

24. The method according to claim 18 further comprising:

removing the plug; and sealing a mouth of another container using the plug.

25. A reusable connection operable to restrict an opening of a bottle having contents therein, the bottle including a mouth having an inner surface of an inside diameter and an outer surface of an outside diameter, the inside diameter being within a predefined range and the outer surface including plural threads extending about the mouth, the reusable connection comprising:

a plug configured to engage the inner surface of the mouth, the plug being frustoconical and having a tapered side surface of varying dimension corresponding to the predefined range, the tapered surface of the plug being configured to form a seal with the inner surface of the mouth, the plug having a first aperture and second aperture individually axially extending from an outer surface of the plug to an inner surface of the plug;

a withdrawal tube configured to pass through the first aperture of the plug and permit withdrawal of the contents of the bottle through the plug;

a ventilation tube configured to pass through the second aperture of the plug and permit passage of air into the bottle through the plug;

a plurality of retaining members individually having a first end and a second end, the first ends of the retaining members being configured for attachment to the plug and the second ends of the retaining members being distally spaced from the respective first ends and configured to form respective loops; and an adjustable retention hook and loop strap provided through the loops of the respective retaining members and the strap being configured for reception between adjacent threads of the mouth to maintain the seal of the tapered surface of the plug with the inner surface of the mouth.

* * * * *